US008955738B2

(12) United States Patent
Cai et al.

(10) Patent No.: US 8,955,738 B2
(45) Date of Patent: Feb. 17, 2015

(54) FOOD SCOOP WITH TOP CLOSURE

(75) Inventors: Liming Cai, West Chester, PA (US); Angela E. Learn, Gilbertsville, PA (US)

(73) Assignee: Pactiv Packaging Inc., Lake Forest, IL (US)

( * ) Notice: Subject to any disclaimer, the term of this patent is extended or adjusted under 35 U.S.C. 154(b) by 322 days.

(21) Appl. No.: 13/109,936

(22) Filed: May 17, 2011

(65) Prior Publication Data

US 2012/0292382 A1 Nov. 22, 2012

(51) Int. Cl.

| | |
|---|---|
| ***B65D 3/10*** | (2006.01) |
| ***B65D 5/66*** | (2006.01) |
| ***B65D 81/32*** | (2006.01) |
| ***B65D 5/18*** | (2006.01) |

(52) U.S. Cl.

CPC ..... *B65D 5/6685* (2013.01); *B65D 81/3205* (2013.01); *B65D 5/18* (2013.01); *Y10S 229/906* (2013.01)

USPC ..... 229/404; 229/400; 229/906

(58) Field of Classification Search

USPC ..... 229/400, 404, 904, 906, 120.18

See application file for complete search history.

(56) References Cited

U.S. PATENT DOCUMENTS

| | | | | |
|---|---|---|---|---|
| 2,367,780 | A * | 1/1945 | Inman | 229/113 |
| 2,966,293 | A | 12/1960 | Goldsholl | |
| 3,637,130 | A | 1/1972 | Farquhar | |
| 3,809,310 | A | 5/1974 | VanderLugt, Jr. | |
| D232,214 | S | 7/1974 | Biderman | |
| 4,711,389 | A | 12/1987 | Alba et al. | |
| 4,714,190 | A | 12/1987 | Morrocco | |
| D306,975 | S | 4/1990 | Brondyke et al. | |
| 4,915,235 | A | 4/1990 | Roosa | |
| D355,598 | S | 2/1995 | Aronhalt | |
| 5,979,745 | A | 11/1999 | Surlina | |
| D433,330 | S | 11/2000 | Hudson | |
| 6,176,420 | B1 | 1/2001 | Sarson et al. | |
| 6,182,890 | B1 * | 2/2001 | Sattler et al. | 229/400 |
| 6,360,944 | B1 * | 3/2002 | Gorman | 229/400 |
| D456,253 | S | 4/2002 | Bryan et al. | |
| D469,691 | S | 2/2003 | Brondyke et al. | |
| 6,592,504 | B2 | 7/2003 | Sarson et al. | |
| 6,719,192 | B2 * | 4/2004 | Barcat et al. | 229/400 |
| 6,758,390 | B2 | 7/2004 | Sarson et al. | |
| D495,209 | S | 8/2004 | Tranfaglia et al. | |
| D502,364 | S | 3/2005 | Chan | |
| 6,955,289 | B2 * | 10/2005 | Green | 229/128 |
| D592,504 | S | 5/2009 | Jacobsson | |
| D596,022 | S | 7/2009 | van den Berg | |
| 7,661,580 | B1 | 2/2010 | Bazan | |
| 2001/0030227 | A1 * | 10/2001 | Fear et al. | 229/120.01 |
| 2004/0211823 | A1 | 10/2004 | Sarson et al. | |
| 2006/0266816 | A1 | 11/2006 | Voigt | |
| 2010/0102110 | A1 | 4/2010 | Learn | |

* cited by examiner

*Primary Examiner* — Gary Elkins
*Assistant Examiner* — Scott McNurlen
(74) *Attorney, Agent, or Firm* — Baker Botts L.L.P.

(57) ABSTRACT

A food scoop of a generally upwardly tapering truncated configuration having a lower portion of rectangular cross section and an upper portion of circular cross section with a bottom in edge contact with the peripheral wall of the scoop completely thereabout and with opposed combined glue and sealing flaps integral with the bottom and bonded to opposed sides of the scoop wall and with the upper portion of the scoop terminating in a foldable closure means.

23 Claims, 12 Drawing Sheets

FOOD SCOOP WITH TOP CLOSURE

BACKGROUND OF THE INVENTION

Food scoops of the type normally referred to as fry scoops are widely used in coffee shops, quick service restaurants, convenience stores, and other such "fast food" establishments, for the dispensing of chips, fries, popcorn, chicken nuggets, and like "finger" foods.

Such known scoops are of a generally narrow rectangular or slightly rounded configuration, with a higher back wall providing for or assisting in the scooping of the fries, or other foodstuffs therein.

With the conventional generally round or conical scoop, the container, when filled, will normally lie flat on its back panel with the contents tending to spill from the open mouth thereof.

The conventional scoop also incorporates multiple vertical fold lines extending for the full height thereof and defining distinct narrow planar sides to the scoop which do not particularly lend themselves to a continuous surface pattern about the peripheral wall of the scoop. Problems may also arise with regard to the proper filling of the conventional scoop, and the withdrawal of foods therefrom in light of the relatively narrow elongate nature of the scoop and the angular corners provided about the interior thereof.

One improved form of food carton will be noted in U.S. Patent Application Publication No. 2010/0102110. This carton is of a preformed, inverted configuration with features for holding the food product within the carton.

Existing containers have been proposed as providing for a closable lid whereby the heated food contents are kept warm during carrying or transporting of the food, and whereby the food contents are retained inside the container if it is accidentally tipped over from a standing position. However, there is much room for improvement.

In this regard, a closable container has not heretofore particularly lent itself to formation from a single blank without relying on a rather complex arrangement of fold and score lines and a corresponding use of extra material beyond that actually required to form the food chamber. This in turn also leads to an increase in the time and complexity of the actual manufacturing process.

SUMMARY OF THE INVENTION

The present invention proposes significant advances in the art with regard to many aspects of the conventional food scoop and known variations thereof.

Initially, the scoop of the invention is capable of being formed utilizing conventional equipment with the formed configuration of the scoop specifically allowing for nesting of the scoops so as to minimize packing space, resulting in both shipping and storage economies. The formed configuration of the scoop provides a base which is not only readily accommodated within a conventional cup holder, whether in a carrying tray or a vehicle mounted cup holder, but is also particularly formed to provide a stable base for a self-standing scoop.

Another object of the invention is the incorporation of a closable lid whereby the heated contents of the scoop are kept warm during carrying or transporting of the food and scoop, and whereby the food contents are retained inside the scoop if the scoop is accidentally tipped over from a standing position.

Another object of the invention is the incorporation in the scoop of a sealed bottom, eliminating the gaps normally associated with folded paperboard cartons of this type. Thus, the scoop of the invention is particularly capable of accommodating various condiments and flavorings as might be applied to the finger foods supplied within the scoop, for example melted butter on popcorn, salt and vinegar on fries of various types, ketchup on chicken poppers or chicken nuggets, and the like, all without leakage.

Another object of the invention is the incorporation of removable panels in one or more of the wall panels of the food scoop, such that the aperture created upon removal of the panels are able to receive and retain a conventional condiment package, such as a dipping sauce, or ketchup package, or the like.

Also of particular significance is the formation of the scoop using a unitary blank which provides for an improved production layout with very limited scrap area, utilizing minimal board to obtain maximum volume. The actual nature of the blank from which the carton is formed, and the configuration of the formed carton, combine to allow a manufacturing system utilizing traditional equipment with the blank, with minimal fold lines, allowing for increased forming speed of the equipment, simplified and more easily performed folding steps, and blank elements which cooperate during the folding procedure, aligning on and relative to each other in achieving the desired closable lid configuration.

Other features and details of the scoop and blank comprising the invention will become apparent from the following more specific description of the invention.

DESCRIPTION OF THE PREFERRED EMBODIMENTS

Figure 1:
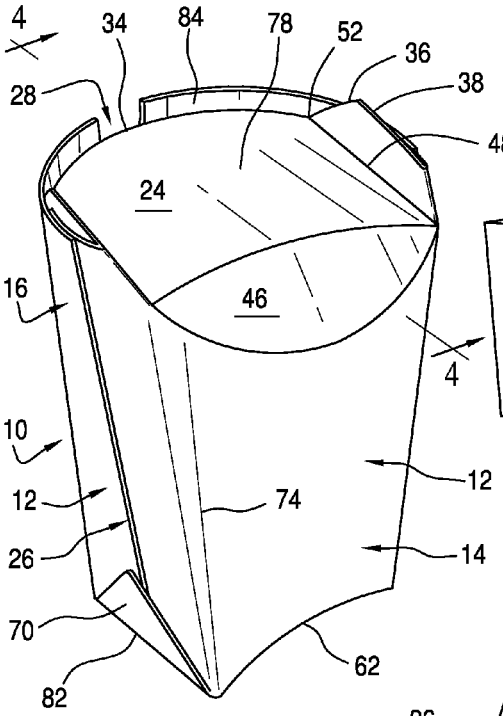
FIG. 1 is a top rear perspective view of the scoop of the invention with the lid in a closed position.
Figure 2:
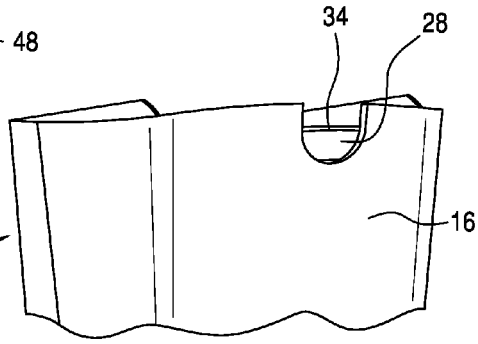
FIG. 2 is a partial top front perspective view of the upper portion of the food scoop.
Figure 3:
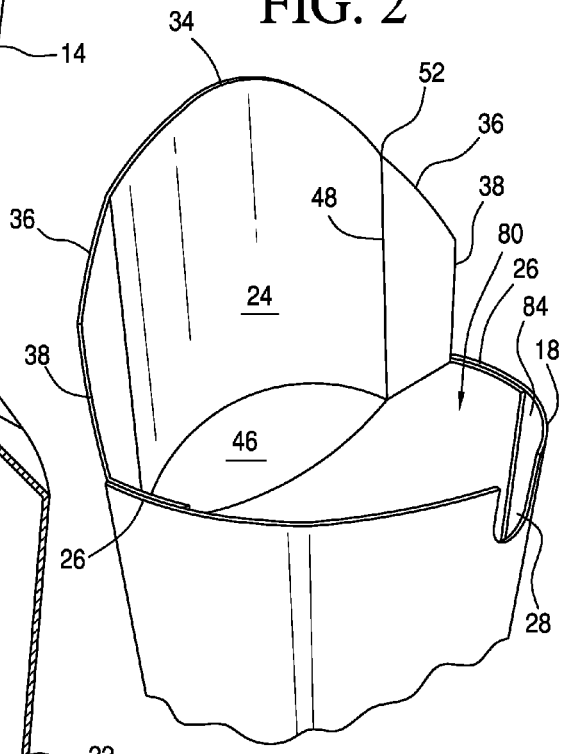
FIG. 3 is a partial top rear perspective view of the upper portion of the food scoop with the lid in an open position.
Figure 4:
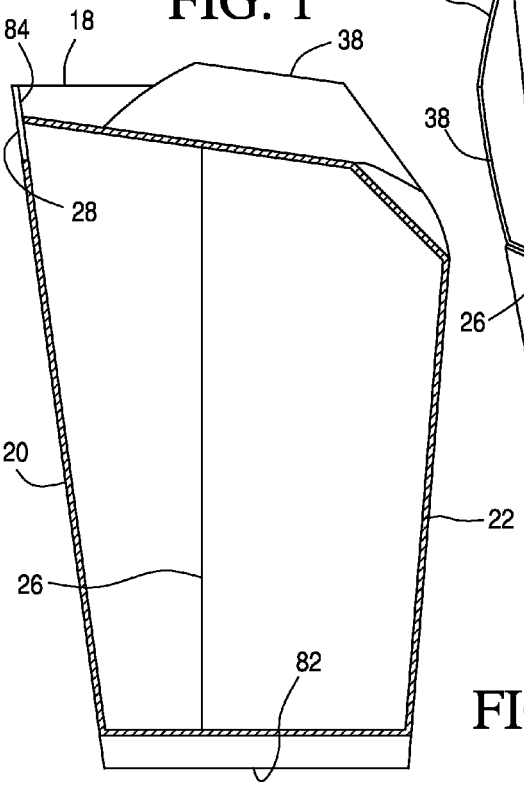
FIG. 4 is a vertical cross-sectional view through the scoop taken substantially on a plane passing along line 4-4 in FIG. 1.

Referring now more specifically to the drawings, the scoop or food carton 10 includes a vertical, peripheral wall 12 of a generally conical configuration increasing upwardly from a lower portion 14 of substantially rectangular, and preferably square, cross section, to an upper portion 16 of a substantially round cross section which extends to an enlarged arcuate and generally inclined integral lid panel 24 (FIGS. 1-3).

Figure 5:
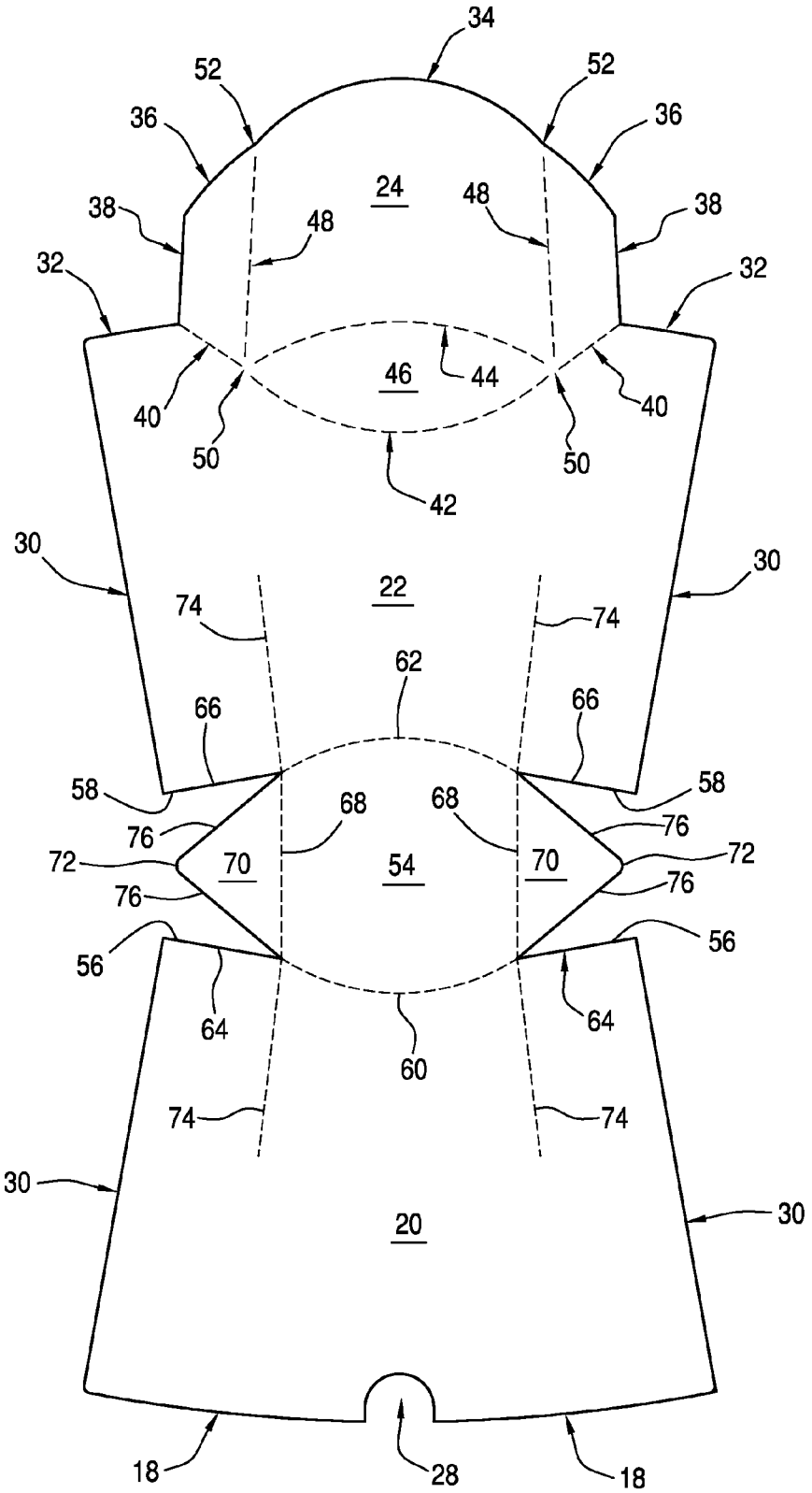
FIG. 5 is a plan view of the blank from which the scoop of FIGS. 1-4 is folded.

The wall 12, also noting the blank of FIG. 5, is defined by front and rear wall panels 20 and 22 inwardly rolled toward each other into semi-cylinders with overlapping edge portions adhesively bonded to form opposed side seams 26 (FIG. 1).

The specific nature of the upper portion of the scoop 10, that is, the linear forward edge portion 18, and the higher integral foldable lid portion 24, are achieved by configuring these edge portions as noted in the blank of FIG. 5. More specifically, the upper or outer edge 18 of the front wall panel 20 is slightly convex along a major extent thereof. A "D-shaped" cut-out 28 is made at the upper or outer edge 18 of the front wall panel 20, substantially along a midpoint thereof. This cut-out 28 serves as a convenient opening in which the user can locate the outer or upper edge 34 of the lid panel 24 (FIG. 5), to open the lid of the cup while the lid is in a closed position (FIGS. 1-2), as will be more fully described.

Of particular significance is the integral lid portion 24 of the scoop 10. With reference to the blank of FIG. 5, and the arrangement of the rear wall panel 22 and integral lid portion 24, it will be noted that the opposed upwardly diverging side edges 30 of the rear wall panel 22 terminate in opposed edge extents 32, which are disposed at approximately 90 degrees to side edges 30. The outer or upper edge of the lid portion 24 includes a convex central length or extent 34, terminating in a pair of opposed arcuate portions 36. As illustrated in the blank (FIG. 5), a pair of opposed lid edges 38 diverge downwardly and slightly outwardly from the end of arcuate portions 36 to the inner limit of opposed edge extents 32.

A pair of short linear fold lines 40 extend angularly from the confluence of the lid edges 38 and edge extents 32 of the rear wall panel 22, terminating at the apices 50 of oppositely-bowed fold lines 42, 44, which define convex-concavo area 46. Longitudinally directed linear folds lines 48, essentially parallel to the opposed lid edges 38, extend downwardly and slightly outwardly from the confluences 52 of the convex central length 34 and opposed arcuate portions 36.

As shall be referred to in more detail subsequently, fold lines 40, 42, 44, and 48 allow for a forward and downward folding of the convex-concavo area 46 and lid panel 24 to close the scoop 10.

Of further significance is the lower portion 14 of the scoop 10, the rectangular or square cross section thereof and the planar imperforate bottom panel 54.

With reference to the blank of FIG. 5, and the linear alignment of the front and rear wall panels 20 and 22, it will be noted that the facing base wall edges 56 and 58 of the front and rear wall panels 20 and 22 respectively, include arcuate central extents 60 and 62, with the bottom panel 54 being integral with the front and rear wall panels along bottom wall end edges coextensive with the arcuate extents 60 and 62. An arcuate fold line is defined along each of the central arcuate extents 60 and 62, also illustrated in the blank by these reference numerals, thus allowing for an upward folding of the front and rear wall panels as shall be referred to subsequently. Optionally, the facing base wall edges 56 and 58 of the front and rear wall panels 20 and 22 respectively, include linear central extents 60 and 62, with the bottom panel 54 being integral with the front and rear wall panels along bottom wall end edges coextensive with the linear extents 60 and 62, as seen in the embodiment of FIG. 13.

Noting the formed carton of FIG. 1, it will be seen that the arcuate end edges 60 and 62 of the bottom panel 54 produce a side-to-side upward arching of the bottom panel 54 between the front and rear of the formed carton. Formed in this manner, the actual support of the carton, that is the support base thereof, is provided by a pair of full length laterally spaced bottom edges 82 defined at the opposed side edges of the bottom panel 54 and at the fold lines between the bottom panel 54 and the corresponding upwardly extending triangular sealing panels 70. Such an arched configuration of the bottom panel 54 strengthens the carton and provides for an actual increase in the internal volume of the carton through a slight outward bulging of the forward and rear sections of the front and rear wall panels while retaining the substantially rectangular lower portion of the carton. This is achieved without increasing the amount of material used in the construction of the carton or modification of the actual forming steps involved. In addition, by providing for the support of the carton along only a pair of opposed linear bottom edges 82, the stability of the carton in a self-supporting situation is enhanced. In other words, any surface irregularities in the support surface, whether a tabletop, the ground, or the like, can be readily accommodated by the spaced support edges, which might be considered as elongate support feet, as compared to the completely planar support surface formed by the later described bottom panel 54.

Figure 13:
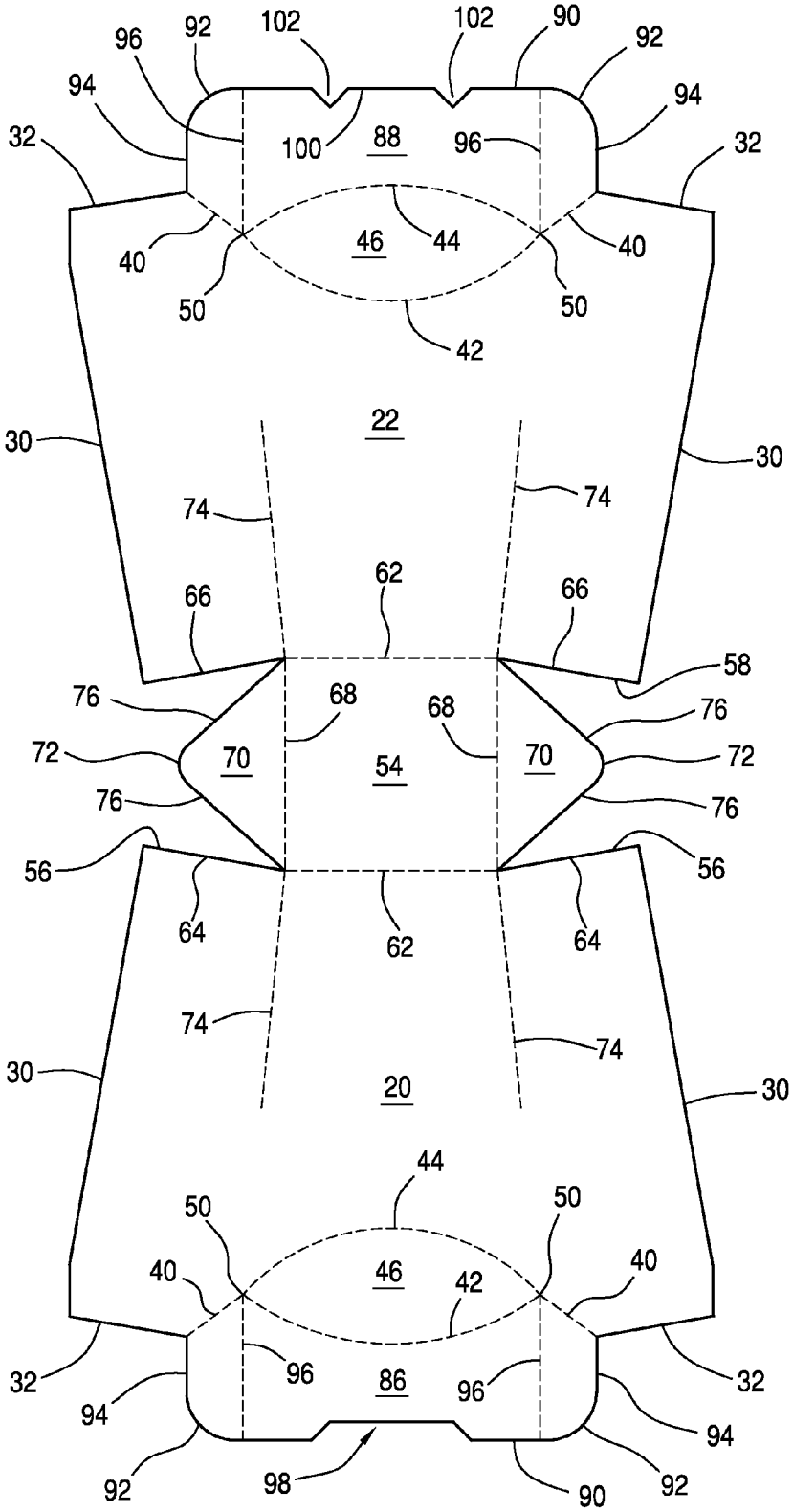
FIG. 13 is a plan view of the blank from which the scoop of FIGS. 10-12 is formed.

Optionally, end edges 60 and 62 may be formed linearly, as shown in FIG. 13 in a different embodiment of the invention. As a result, bottom panel 54 will be flat and not arcuate.

Each of the base wall edges 56 and 58 of the front and rear wall panels, outward of the central arcuate extents 60 and 62, includes a pair of straight or linear end extents 60, 66, extending laterally outward from the opposed ends of the corresponding central arcuate extent 60 or 62, whereby the corresponding extents 64 and 66 at each side of the bottom panel 54 converge slightly outward from the corresponding side of the bottom panel. As will be noted in the blank, these edge extents 64, 66 are each of a length slightly greater than one-half of the length of the corresponding central edge extent 60 or 62, and meet the corresponding side edges 30 or 32 of the front and rear wall panels 20 and 22 at approximately a 90 degree angle.

The bottom panel 54 further includes a pair of laterally spaced parallel straight or linear side edges 68. A side glue and sealing panel 70, of triangular configuration, is integral with and coextensive with the bottom panel 54 along each of the side edges 68 with a single fold line, indicated by the side edge reference numeral 68, along the full length thereof. The side edges 68 of each sealing panel 70, which is basically in the configuration of an isosceles triangle, converge laterally outward to an apex 72 approximately aligned with the outer ends of the front and rear wall panel edges 56 and 58. The blank is completed by the provision of four score or fold lines 74, one line 64 extending upwardly or outwardly into each of the front and rear wall panels 20 and 22 from each opposed end of the central arcuate extents 60 and 62 of the lower edges 56 and 58 of the front and rear panels. The fold lines 74 are in general alignment with the side edges 68 of the bottom panel 54 and extend from the corner defined at the juncture of the base edge end extents 64, 66 and the corresponding base edge central extents 60 and 62.

It will be noted that the inclined inwardly diverging edges 76 of the sealing panels 70 also terminate at this point. The fold lines 74 extend for a minor height of the front 20 and rear 22 wall panels and of the scoop formed therefrom. Such fold lines, in conjunction with the bottom panel 54, function to maintain the desired rectangular configuration of the lower portion 14 of the scoop 10 for a predetermined height sufficient to allow for reception within a conventional automobile cup holder, or the like.

In folding the blank into the scoop configuration, the front and rear wall panels 20 and 22 are upwardly folded along the end edges 60 and 62 of the bottom panel 54. The front and rear walls are inwardly curved to the desired semi-cylindrical configuration with the fold lines 74 allowing for a flattening of the lower portions thereof to achieve the desired rectangular configuration. Noting FIG. 5 in particular, the base edge extents 64, 66 of each of the front and rear wall panels engage, for the full length thereof, directly on the bottom panel 54 along the opposed side edges 68 of the bottom panel 54, overlapping each other, and extending for the full length of the side edges 68 so as to, in effect, seal thereagainst. The linear nature of these base edge extents 64, 66, ensures full length contact with the bottom 54 along the opposed side edges 68 thereof. The right angular relationship of these end extents to the opposed diverging side edges of the front and rear panels also provides for the desired vertical orientation of these front and rear panel side edges in the defined opposed seams 26 of the scoop 10 in conjunction with the upward and outward inclination of the formed front and rear wall panels in the formed scoop.

The formation of the scoop is completed by an upward folding of the combined glue and sealing side panels or flaps 70 to overlie the side walls of the scoop at the seam formed sides thereof so as to both seal the corresponding opposed parallel bottom edges of the carton, and retain the base edge end extents 64 of the front and rear panels fully engaged on the bottom panel 54 along the full length of the opposed side edges 68 thereof. So formed, the linear forward edge 18 of the front wall panel 20 forms the horizontal semi-cylindrical front peripheral wall of the scoop.

The formation of the finished food scoop may be carried out by machine, using conventional processes. Optionally, the food scoop of the invention can be formed by hand.

To close the lid of the scoop, the user exerts force forwardly and downwardly on the central portion of the outer surface 78 of the lid panel 24, in the direction of the lumen 80 of the scoop, causing fold lines 42, 44 to bend forward towards lumen 80, and fold lines 48 to bend upwardly in an opposite direction (FIG. 1). With the lid panel in a closed and approximately horizontal position, convex central length 34 rests snugly against the inner surface 84 of front wall panel 20, such that the outer edge of the convex central length 34 is accessible through cut-out portion 28 to allow a user's finger to locate the edge of the central length 34 in order to open the lid (FIG. 1).

A further embodiment of the invention is illustrated in FIGS. 6-9, and wherein like components and features have been indicated by like reference numerals. Basically, the only difference in the formation of the blank of FIG. 9 resides in the formation of identical, opposed closure flaps 86 and 88 at the termination, respectively, of the front 20 and rear 22 wall panels.

Figure 9:
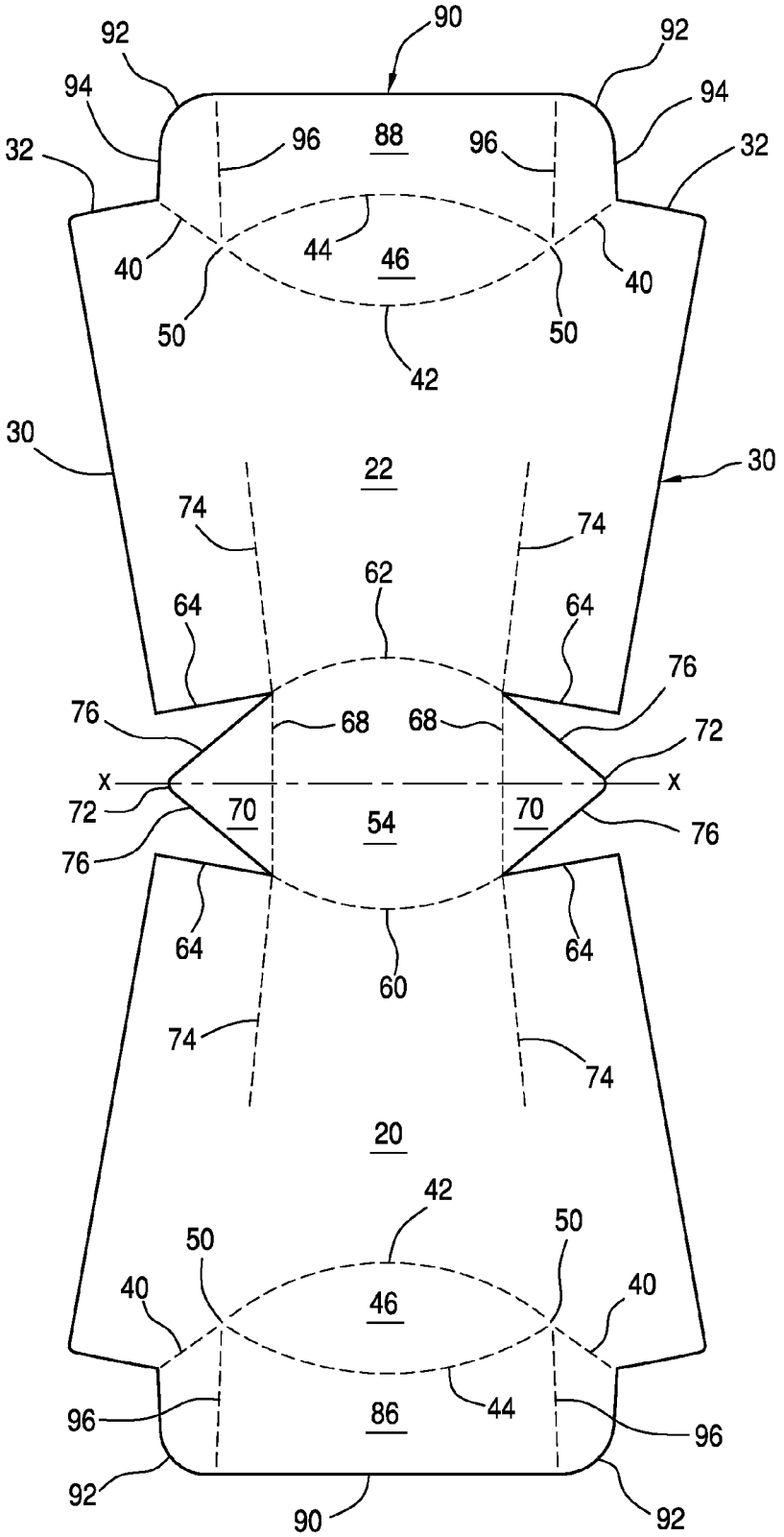
FIG. 9 is a plan view of the blank from which the scoop of FIGS. 6-8 is formed.
Figure 10:
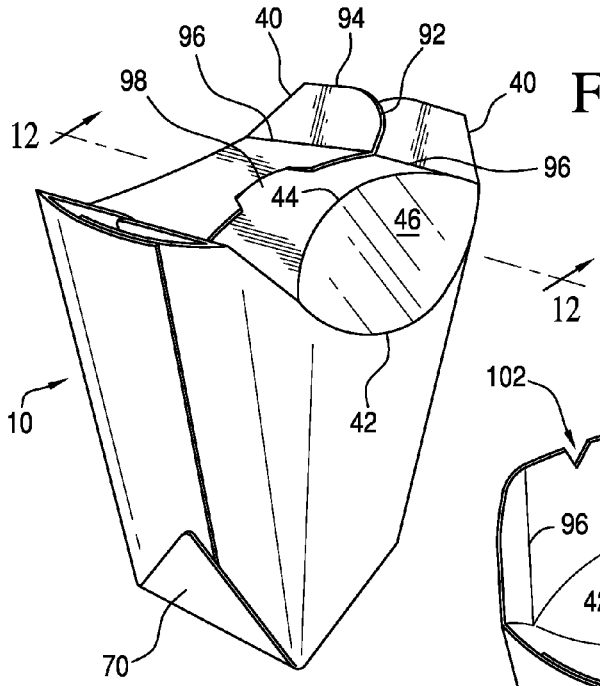
FIG. 10 is a top perspective view of a further modified form of the scoop of FIGS. 6-9 with the lid flaps in a closed and secured position.
Figure 11:
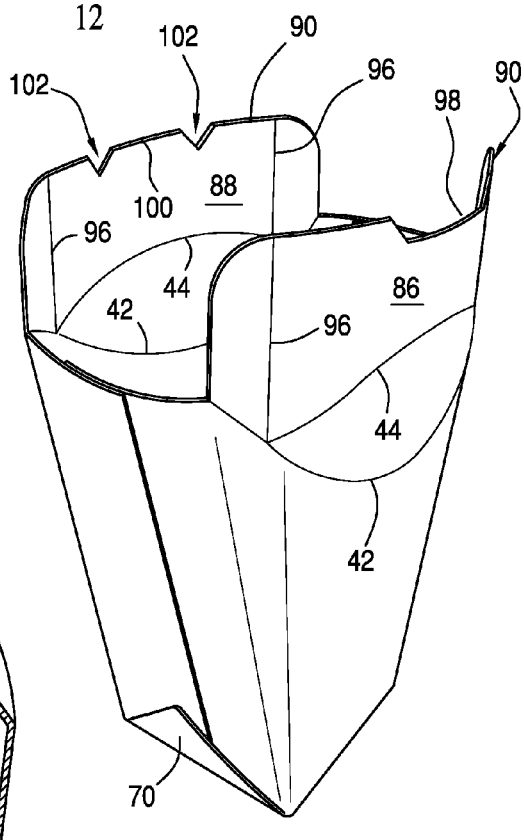
FIG. 11 is a top perspective view of the modified form of the scoop of FIG. 10 with the lid flaps in an open position.
Figure 12:
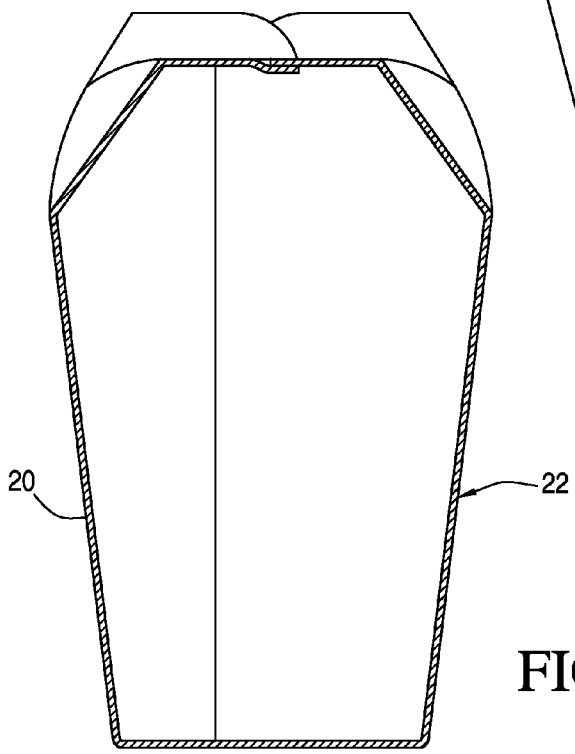
FIG. 12 is a vertical cross-section view of the modified scoop taken substantially on a plane passing along line 12-12 in FIG. 10.

With reference to the blank of FIG. 9, and the arrangement of the rear wall panel 22, it will be noted that the opposed upwardly diverging side edges 30 of the rear wall panel 22 terminate in opposed edge extents 32, which are disposed at approximately 90 degrees to the side edges 30. The outer or upper edge of the closure flaps 86, 88 includes a straight or linear portion 90, terminating in a pair of opposing, rounded corner portions 92. As illustrated in the blank (FIG. 9), a pair of opposing flap edges 94 diverge downwardly and slightly outwardly from the end of corner portions 92 to the inner limit of opposed edge extents 32.

A pair of short linear fold lines 40 extend angularly from the confluence of the flap edges 94 and edge extents 32 of the rear wall panel 22, terminating at the apices 50 of oppositely-bowed fold lines 42, 44, which define convex-concavo area 46. Opposed longitudinally directed linear fold lines 96 extend upwardly from apices 50, and meet linear extent 90, inwardly of corner portions 92 on either side, at approximately a 90 degree angle.

As will be noted from the blank (FIG. 9), the configuration of the closure flap 86 of the front wall panel 20 is identical to the closure flap 88 of the rear wall panel 22, such that the blank is symmetrical about axis X-X.

As with the previously described embodiment, the formed carton of FIGS. 6-9 is sealed about the peripheral edges of the bottom panel 54 with the bottom or base edges of the front and rear panels intimately either integral with or seated in direct engagement with the edges of the bottom panel.

In folding the blank of FIG. 9 into the scoop configuration, the front and rear wall panels 20 and 22 are upwardly folded along the end edges 60 and 62 of the bottom panel 54. The front and rear walls are inwardly curved to the desired semi-cylindrical configuration with the fold lines 74 allowing for a flattening of the lower portions thereof to achieve the desired rectangular configuration. Noting FIG. 9 in particular, the base edge extents 64, 66 of each of the front and rear wall panels engage, for the full length thereof, directly on the bottom panel 54 along the opposed side edges 68 of the bottom panel 54, overlapping each other, and extending for the full length of the side edges 68 so as to, in effect, seal thereagainst. The linear nature of these base edge extents 64, 66, ensures full length contact with the bottom 54 along the opposed side edges 68 thereof. The right angular relationship of these end extents to the opposed diverging side edges of the front and rear panels also provides for the desired vertical orientation of these front and rear panel side edges in the defined opposed seams 26 of the scoop 10 in conjunction with the upward and outward inclination of the formed front and rear wall panels in the formed scoop.

The formation of the scoop is completed by an upward folding of the combined glue and sealing side panels or flaps 70 to overlie the side walls of the scoop at the seam formed sides thereof so as to both seal the corresponding opposed parallel bottom edges of the carton, and retain the base edge end extents 64 of the front and rear panels fully engaged on the bottom panel 54 along the full length of the opposed side edges 68 thereof. So formed, the linear forward edge 18 of the front wall panel 20 forms the horizontal semi-cylindrical front peripheral wall of the scoop.

The formation of the finished food scoop may be carried out by machine, using conventional processes. Optionally, the food scoop of the invention can be formed by hand.

Figure 6:
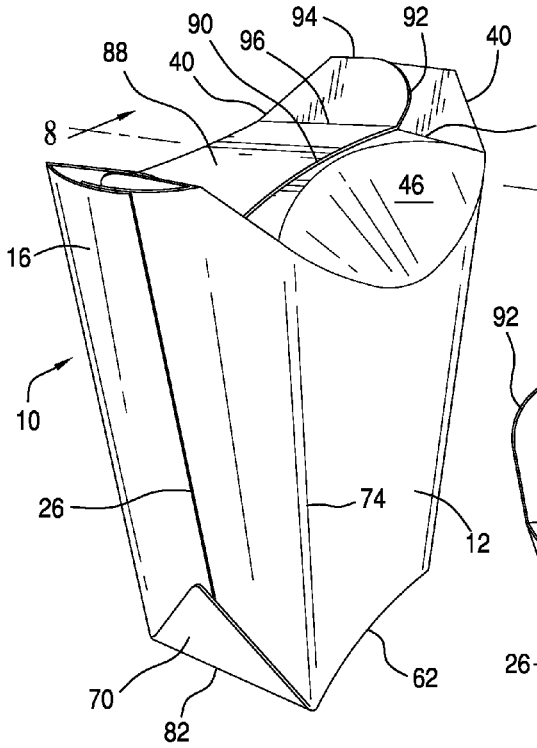
FIG. 6 is a top perspective view of a modified form of the scoop with the lid flaps in a closed position.
Figure 7:
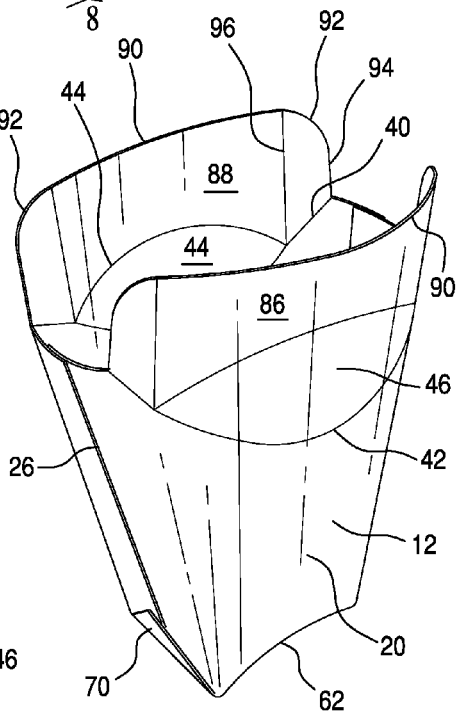
FIG. 7 is a top perspective view of the modified form of the scoop of FIG. 6 with the lid flaps in an open position.
Figure 8:
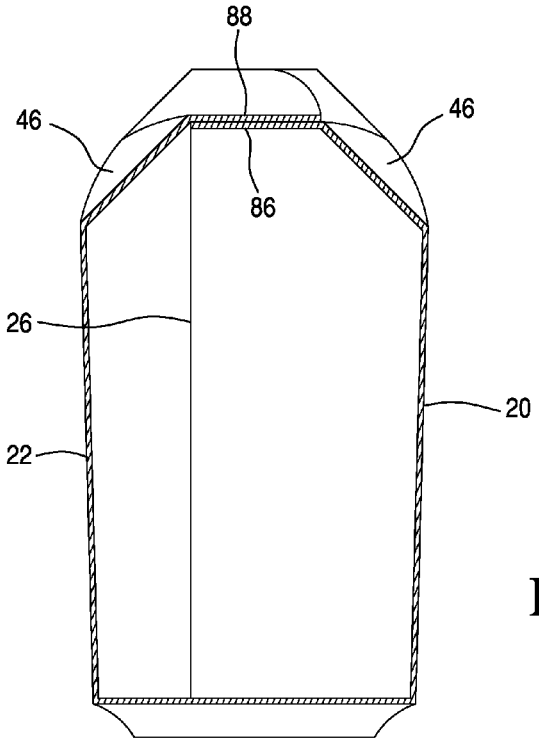
FIG. 8 is a vertical cross-section view of the modified scoop taken substantially on a plane passing along line 8-8 in FIG. 6.

To close the lid of the scoop, the user exerts force forwardly and downwardly on the central portion of the outer surface of the lid panels 84 and 86, in the direction of the lumen 80 of the scoop, causing fold lines 40, 42, and 44 to bend forward towards lumen 80, and fold lines 96 to bend upwardly in an opposite direction (FIG. 6).

A further embodiment of the invention is illustrated in FIGS. 10-13, wherein like components and features have been indicated by like reference numerals. Basically, the only difference in the formation of the blank of FIG. 13 resides in the formation of female 98 and male 100 closure tabs located on the linear portion 90 of closure flaps 86 and 88 respectively.

As can be see from FIG. 13, the female closure tab 98 is formed as a notch or indentation in the central portion of the linear portion 90 of closure flap 86. The male closure tab 100 is formed by two V-shaped cut out notches 102 in the central area of linear portion 90 of closure flap 88. As will be apparent, the dimensions of the female tab portion 98 and male tab portion 100 correspond, such that the female and male tab portions interlock to close the food scoop, when closure flaps 86 and 88 are in their closed and folded position over the lumen of the food scoop.

A further embodiment of the invention is illustrated in FIGS. 14-17, wherein like components and features have been indicated by like reference numerals. Basically, the only difference in the formation of the blank of FIG. 17 resides in the formation of a perforated, or partially perforated, tear-back 108 portion 108 in the rear wall panel 22, the tear-back panel 108 being defined by a through-cut 116 and severance or tear lines 110, 112, 114.

Figure 17:
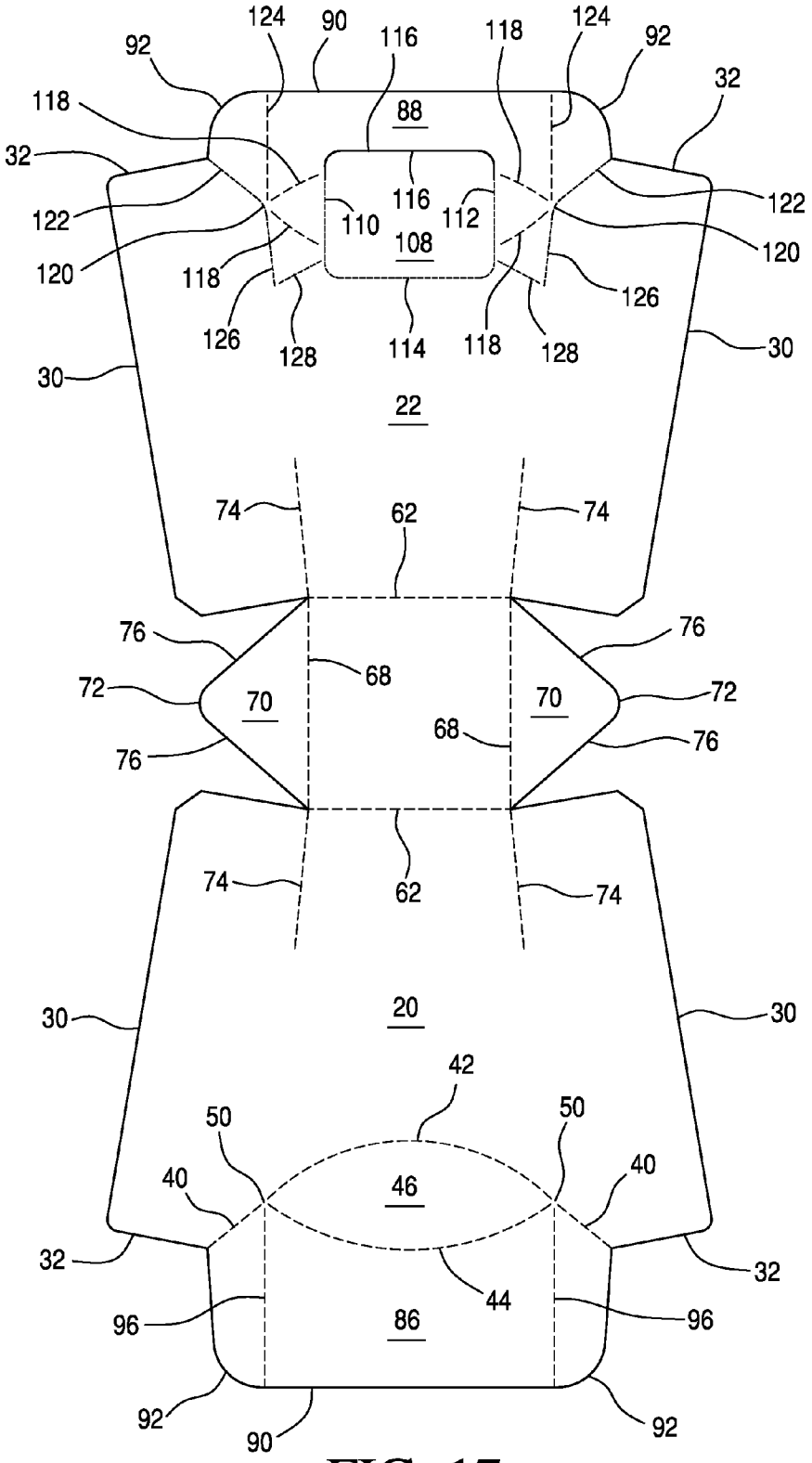
FIG. 17 is a plan view of the blank from which the scoop of FIGS. 14-16 is formed.
Figure 18:
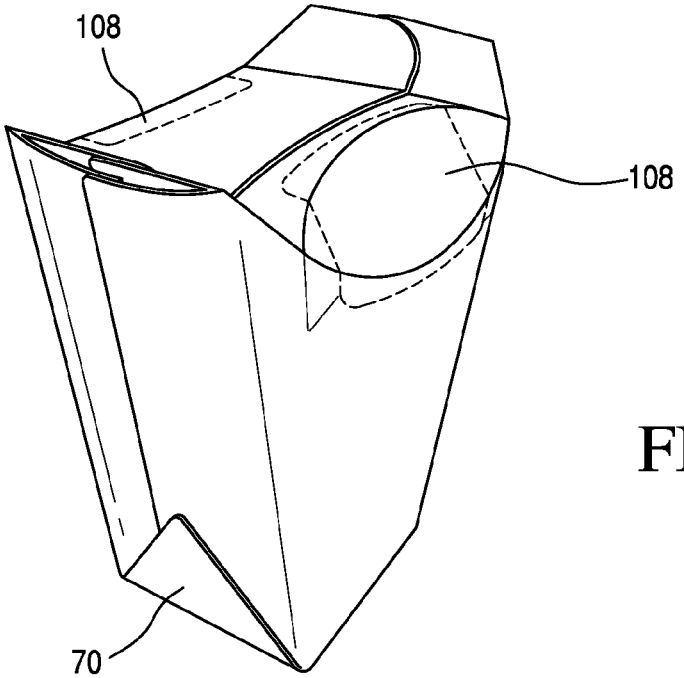
FIG. 18 is a top perspective view of a modified form of the scoop of FIGS. 14-17 with the lid flaps in a closed position, and with two tear-back panels attached.

With reference to the blank of FIG. 17, and the arrangement of the rear wall panel 22, it will be noted that an essentially rectangular tear-back panel 108 is formed in the upper portion of the rear wall panel 22, approximately centrally along the longitudinal axis of the food scoop 10. Optionally, the tear-back panel 108 may be of a generally square configuration.

When the tear-back panel 108 is partially removed from the formed food scoop, such that tear-back panel 108 remains attached to the rear wall panel 22 of the food scoop 10 substantially along its lower edge 114, the resulting aperture in rear wall panel 22 has a size and dimension sufficient to accommodate and retain a conventional condiment or dipping sauce container 132 that is common in the fast-food industry. Optionally, the shape of the tear-back panel 108, and the resulting aperture formed by partial removal of the tear-back panel 108, may be square to correspond to a square-shaped condiment or dipping sauce container.

Optionally, the aperture for the condiment or dipping sauce container 132 may be formed by completely removing tear-back panel 108.

Referring to the blank of FIG. 17, the tear-back panel 108 has sides 110, 112 and lower edge 114 thereof defined by severance or tear lines, which are perforated to allow easy removal of the tear-back panel 108 by the consumer. Preferably, the upper edge 116 of the tear-back panel 108, that is, one of the longest edges of the tear-back panel 108 closest to and parallel with the linear portion 90 of the food scoop, is defined by a through-cut in the material of the food scoop, the reasons for which will be described below. Optionally, however, upper edge 116 of the tear-back panel 108 may be defined by a tear line, as with sides 110, 112, and lower edge 116.

As illustrated in the blank (FIG. 17), a pair of oppositely-bowed fold lines 118 extend from each of the opposing sides 110 and 112 of the tear-back panel 108, each pair of oppositely-bowed fold lines 118 converging and terminating at apices 120.

A pair of short, opposing linear severance or tear lines 122 extend angularly from the confluence of the flap edges 94 and edge extents 32 of the rear wall panel 22, terminating at apices 120 on either side of the tear-back panel 108. Opposed longitudinally directed linear fold lines 124 extend upwardly from apices 120, and meet linear extent 90, inwardly of corner portions 92 on either side, at approximately a 90 degree angle thereto.

As will further be apparent from the blank (FIG. 17), a pair of short linear severance or tear lines 126 extend downwardly and slightly inwardly from apices 120, and terminate in a plane approximately corresponding to the lower edge 114 of the tear-back panel 108. A pair of fold lines 128 extends angularly and upwardly from the lowermost point of tear lines 126, terminating at sides 110 and 112 of the tear-back panel 108, below bowed fold line 118.

The formation of the finished scoop of FIGS. 14-17 is completed essentially in the same manner as described above for the embodiment described in FIGS. 9 to 12.

In folding the blank of FIG. 17 into the scoop configuration, the front and rear wall panels 20 and 22 are upwardly folded along the end edges 60 and 62 of the bottom panel 54. The front and rear walls are inwardly curved to the desired semi-cylindrical configuration with the fold lines 74 allowing for a flattening of the lower portions thereof to achieve the desired rectangular configuration. Noting FIG. 17 in particular, the base edge extents 64, 66 of each of the front and rear wall panels engage, for the full length thereof, directly on the bottom panel 54 along the opposed side edges 68 of the bottom panel 54, overlapping each other, and extending for the full length of the side edges 68 so as to, in effect, seal thereagainst. The linear nature of these base edge extents 64, 66, ensures full length contact with the bottom 54 along the opposed side edges 68 thereof. The right angular relationship of these end extents to the opposed diverging side edges of the front and rear panels also provides for the desired vertical orientation of these front and rear panel side edges in the defined opposed seams 26 of the scoop 10 in conjunction with the upward and outward inclination of the formed front and rear wall panels in the formed scoop.

The formation of the scoop is completed by an upward folding of the combined glue and sealing side panels or flaps 70 to overlie the side walls of the scoop at the seam formed sides thereof so as to both seal the corresponding opposed parallel bottom edges of the carton, and retain the base edge end extents 64 of the front and rear panels fully engaged on the bottom panel 54 along the full length of the opposed side edges 68 thereof. So formed, the linear forward edge 18 of the front wall panel 20 forms the horizontal semi-cylindrical front peripheral wall of the scoop.

The formation of the finished food scoop may be carried out by machine, using conventional processes. Optionally, the food scoop of the invention can be formed by hand.

Figure 14:
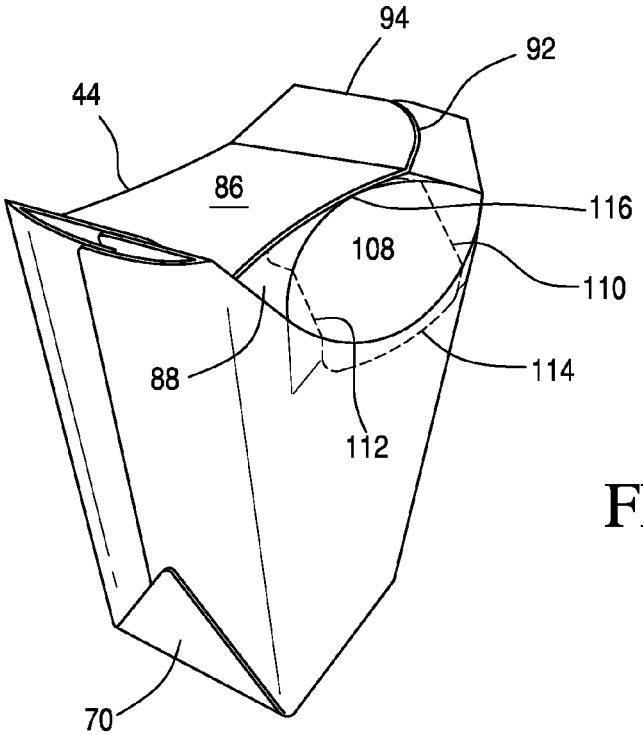
FIG. 14 is a top perspective view of a modified form of the scoop with the lid flaps in a closed position, and with tear-back panel attached.

To close the lids of the scoop, the user exerts force forwardly and downwardly on the central portion of the outer surface of the lid panels 84 and 86, in the direction of the lumen 80 of the scoop, causing fold lines 118 and 122 to bend forward towards lumen 80, and fold lines 124 to bend upwardly in an opposite direction (FIG. 14).

As can be seen from FIG. 14, in the finished and closed food scoop 10, closure flap 86 overlies closure flap 88 when the food scoop 10 is closed to retain the food items.

To use the food scoop 10 of FIGS. 14-17 as a condiment holder, the user will place closure flaps 86 and 88 in an essentially upright, or "open", position. In this configuration, it will be possible for the user to locate upper edge 116 of the tear-back panel 108 with a finger or fingers, and to tear back the tear-back panel 108 along the perforations of sides 110 and 112, while at the same time folding the tear-back panel 108, along perforated lower edge 114, downwardly and inwardly towards the peripheral vertical wall 12 of the food scoop 10. As a consequence, a rectangular aperture 130 will be formed in closure flap 88.

Figure 15:
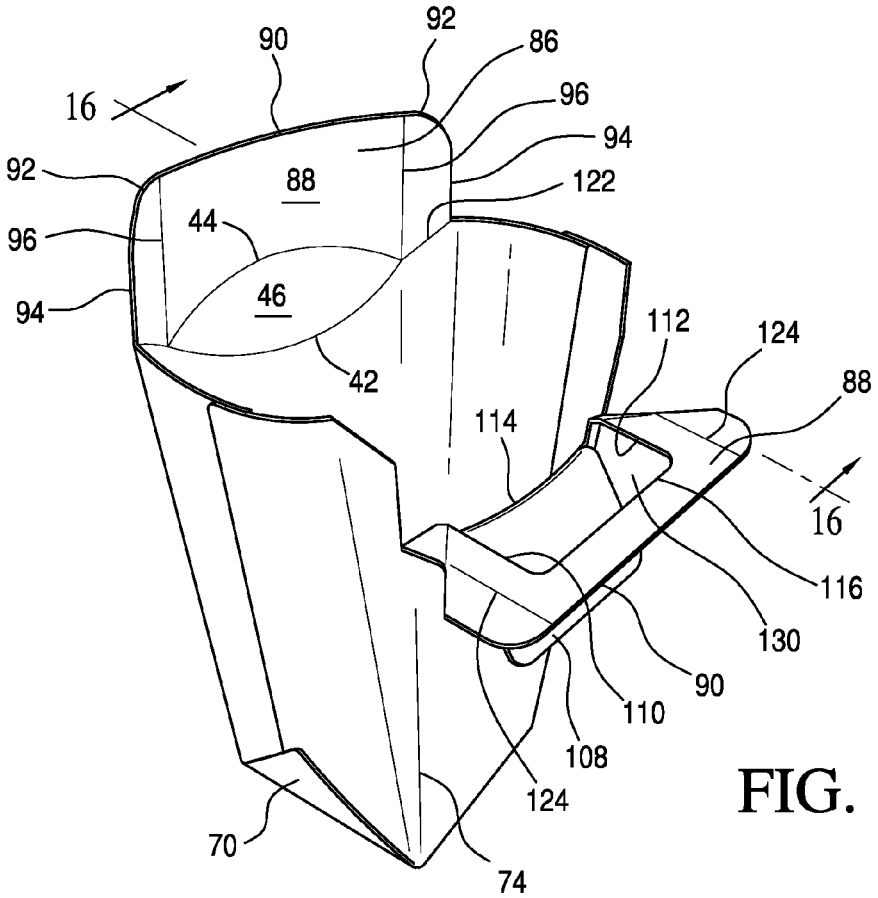
FIG. 15 is a top perspective view of the modified form of the scoop of FIG. 14 with one of the lid flaps in an open position, and the other lid flap in an open and folded back position, and with the tear-back panel partially removed.
Figure 16:
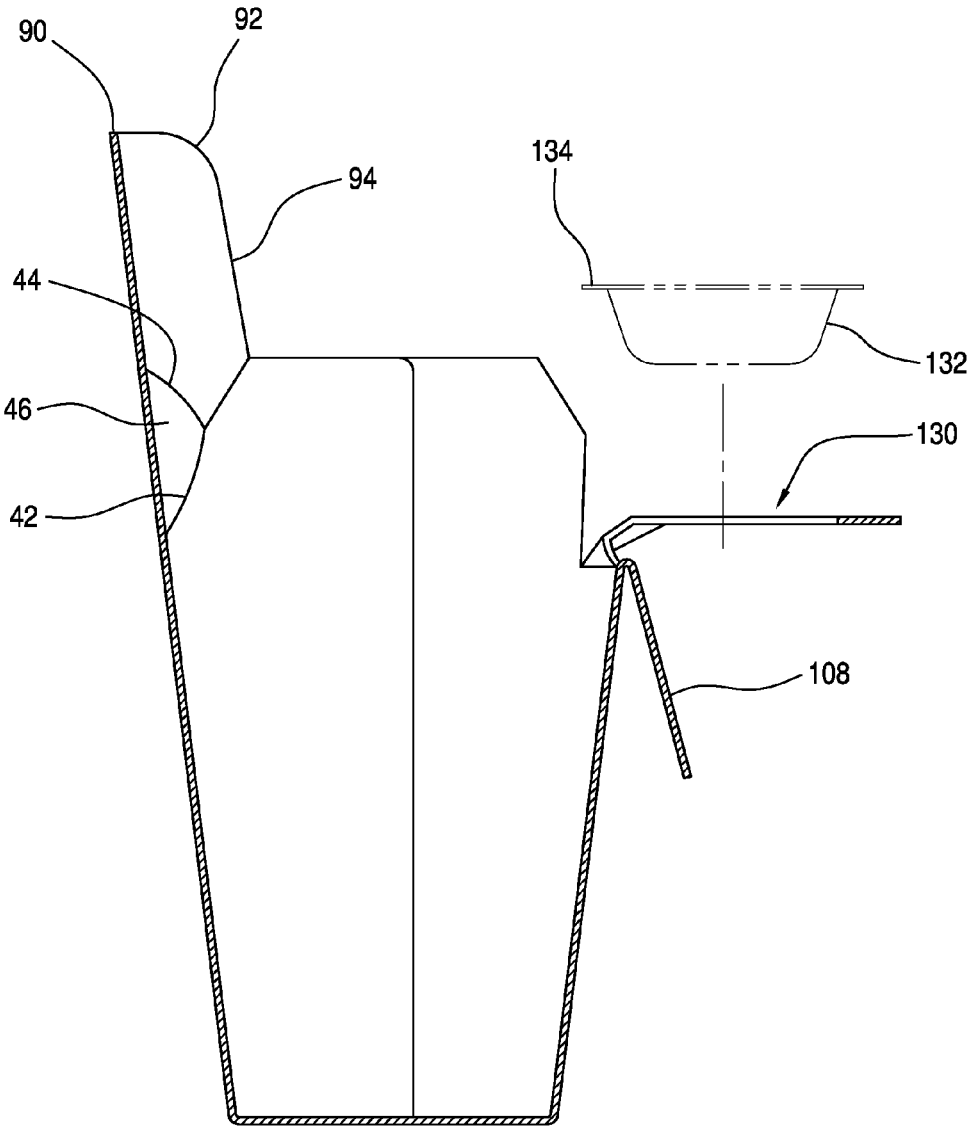
FIG. 16 is a vertical cross-sectional view of the modified scoop taken substantially on a plane passing along line 16-16 in FIG. 15, and showing a sauce or condiment packet before insertion.

Upon gripping the top edge of closure flap 88, the user will then pull closure flap 88 outwardly, and away from the lumen of the food scoop 10, while detaching tear lines 122 and 126, and allowing the closure flap 88 to fold outwards along fold lines 118 and 128. The thickness of the material of the food scoop 10 and the positioning of the fold lines 118 and 128 are such that the folded-out closure flap 88 will rest approximately horizontally with respect to the food scoop 10, when the food scoop 10 is oriented in an upright position (FIG. 15). As can be seen from FIGS. 15 and 16, the resulting outwardly folded closure flap 88 will allow the user to insert a conventional condiment or sauce container 132 into the rectangular aperture 130 formed by the tearing back of tear-back panel 108. As can be seen in FIG. 15, the dimensions of aperture 130 are slightly less than the dimensions of the "flange" on the lid of the condiment or sauce holder, thus preventing the condiment or sauce container from dropping through the aperture 130. Furthermore, the slight bowing of the vertical peripheral wall 12 of the food scoop 10 will press up against an outer surface of the condiment or sauce container 132, thus functioning to grip and retain the condiment or sauce holder in a secure position in rectangular aperture 130.

Optionally, the aperture for the condiment or dipping sauce container 132 may be formed by completely removing tear-back panel 108. To completely detach the tear-back panel 108, the user will grip the partially detached tear-back panel 108 between a thumb and finger or fingers, and exert a sideways and rearward, or downward pressure to detach the tear-back panel 108 along the perforations of lower edge 114.

A further embodiment of the invention is illustrated in FIGS. 18-21, wherein like components and features have been indicated by like reference numerals. Basically, the only difference in the formation of the blank of FIG. 21 resides in the formation of opposing closure flaps, each of which comprises a tear-back panel 108, at the termination, respectively, of the front 20 and rear 22 wall panels.

As will be noted from the blank (FIG. 21), the configuration of the closure flap 86 of the front wall panel 20 is identical to that of the rear wall panel 22, such that the blank (FIG. 21) is symmetrical about axis X-X.

To use the food scoop 10 of FIGS. 18-21 as a condiment holder, the user will tear back the tear-back panels 108 along the perforations of sides 112 and 112.

Figure 19:
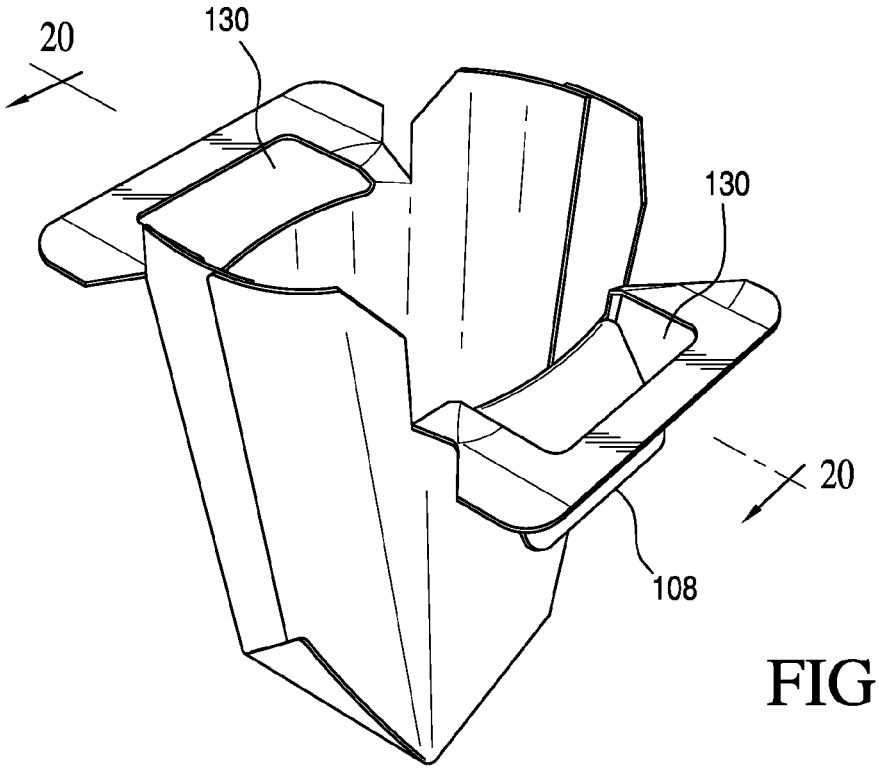
FIG. 19 is a top perspective view of the modified form of the scoop of FIG. 18 with both lid flaps in an open position and folded back position, and with one tear-back panel removed and one tear-back panel partially removed.
Figure 20:
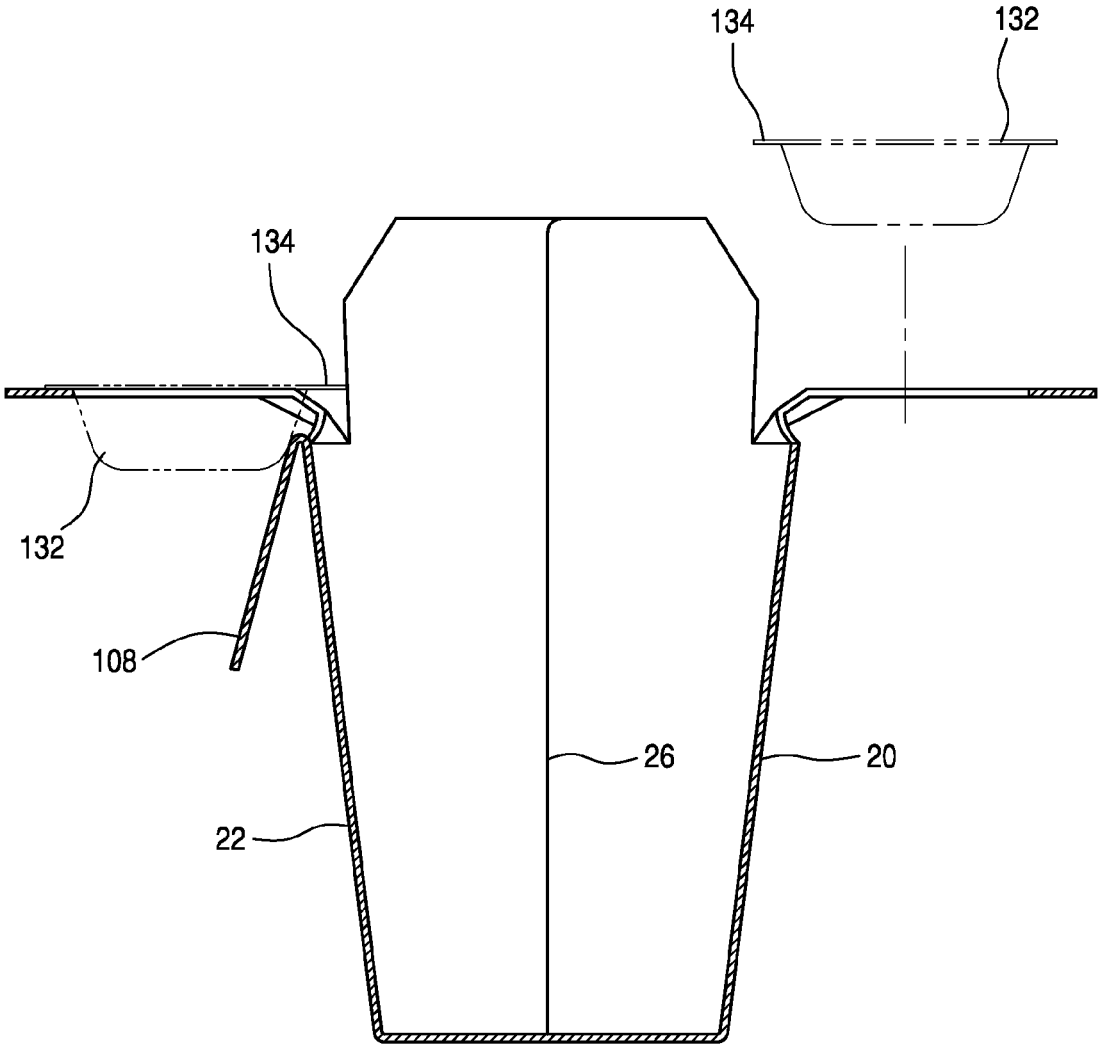
FIG. 20 is a vertical cross-section view of the modified scoop taken substantially on a plane passing along line 20-20 in FIG. 19, and showing a condiment or sauce packet received in one lid flap.
Figure 21:
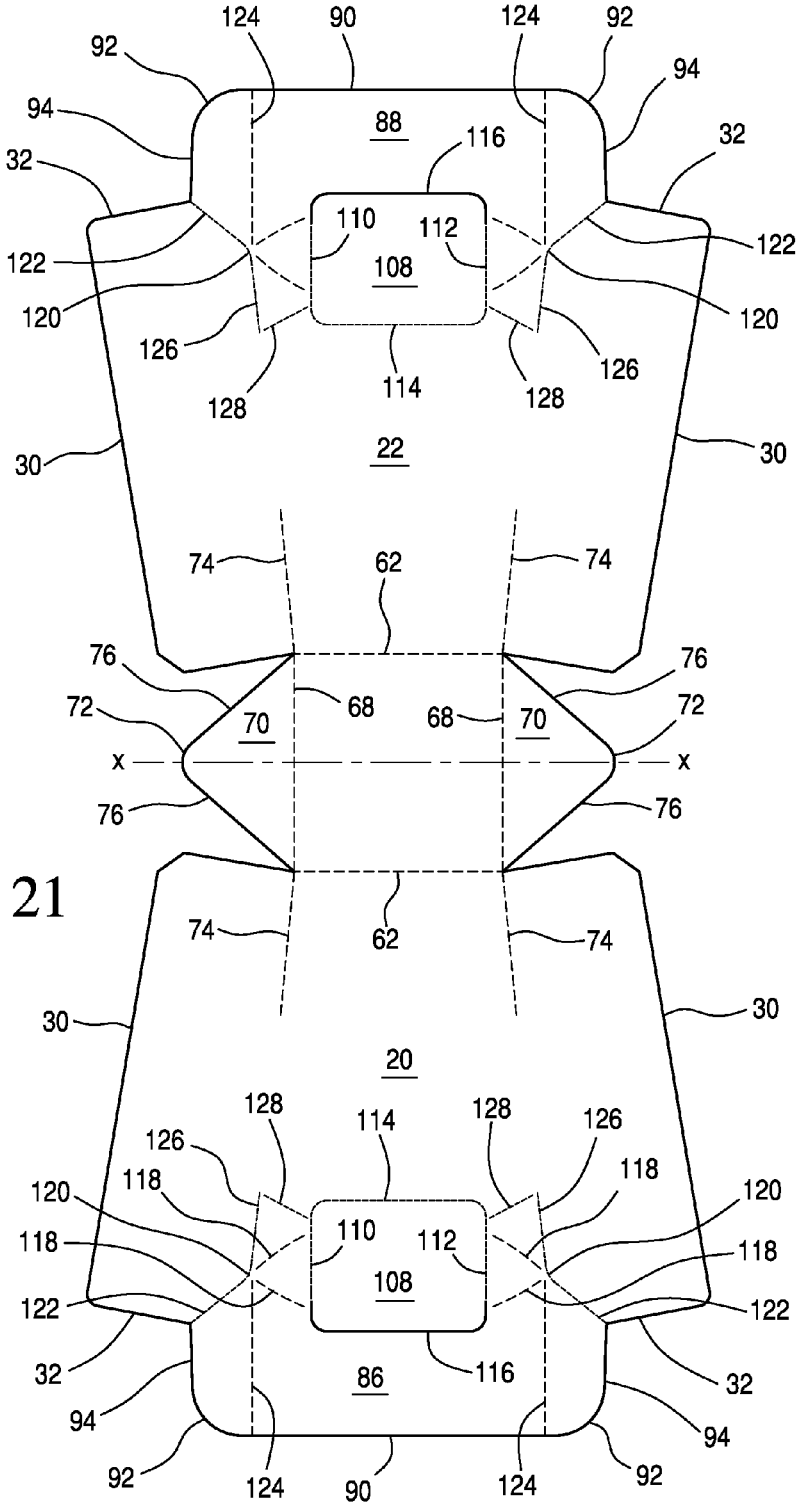
FIG. 21 is a plan view of the blank from which the scoop of FIGS. 18-20 is formed.

To use the food scoop 10 of FIGS. 18-21 as a condiment holder, the user will open closure flaps 86 and 88. In this configuration, the user will then partially remove the tear-back panels 108 from each of closure flaps 86 and 88, essentially in the manner described above for the food scoop 10 of FIGS. 14-17. As a consequence, rectangular apertures 130 will be formed in closure flaps 86 and 88. Taking one closure flap at a time, upon gripping the top edge of closure flaps 86 and 88, the user will then pull closure flaps 86 and 88 out, away from the lumen of the food scoop 10, while detaching tear lines 122 and 126, and allowing the closure flap 88 to fold outwards along fold lines 118 and 128. The thickness of the material of the food carton 10 and the positioning of the fold lines 118 and 128 are such that the folded-out closure flaps 86 and 88 will rest approximately horizontally with respect to the food scoop 10, when the food scoop 10 is oriented in an upright position (FIGS. 19 and 20). As can be seen from FIGS. 19 and 20, the resulting outwardly folded closure flaps 86 and 88 will allow the user to insert a conventional condiment or sauce container 132 into each of the rectangular apertures 130 formed by the partial removal of tear-back panels 108.

It is contemplated that the tear-back panel 108 could be used as a prize or prize coupon, after the tear-back panel or panels are completely removed from the food scoop 10, essentially in the manner described above for the food scoop 10 of FIGS. 14-17. The coupon will have the nature of the prize indicated thereon, for example the phrase "Free Drink". Alternatively, the tear-back panel 108 can be used as a game piece that the consumer collects in order to accumulate a sufficient number of game pieces of the required type to win a prize. It is further contemplated that one tear-back panel of FIGS. 18-21 could be used as a prize or coupon, and the other tear-back panel as prize or coupon, or as a game piece.

From the foregoing, it will be appreciated that a unique food scoop has been defined which, both structurally and functionally, constitutes a significant advance in the art. As variations, within the scope of the claims appearing hereinafter, may occur to those skilled in the art, it is not intended to limit the invention to the specific embodiments illustrated.

What is claimed is:

1. A food scoop comprising:

a body portion having a vertically elongate peripheral wall defining an upwardly opening container having a mouth to an interior lumen;

said wall comprising first and second panels and an upper peripheral edge defining a single closure flap foldably connected to a portion of said wall, the closure flap having an upper edge including a pair of opposed arcuate portions having a first radius of curvature and a convex extent disposed therebetween and having a second radius of curvature, and opposing lateral edges with a lateral extent extending from and foldable along each lateral edge, a pair of oppositely-bowed fold lines defining a hinge area between the closure flap and the wall, each oppositely-bowed fold line having opposing ends meeting at an apex proximate each lateral extent, each lateral extent at least partially defined by a linear fold line extending from a corresponding one of the apices to a confluence of the convex extent and one of the opposed arcuate portions, the closure flap moveable about the hinge area between an open position and a position at least partially covering the mouth, and a lower peripheral edge with a bottom panel joined thereto.

2. The food scoop of claim 1, wherein said closure flap is movable between a raised position and a closed position about the hinge area.

3. The food scoop of claim 1, wherein each of the lateral extents extends outwardly from said closure flap when said closure flap is in the open position and extends upwardly from said closure flap when said closure flap is in the position at least partially covering the mouth.

4. A blank for forming the food scoop of claim 1.

5. The food scoop of claim 1, wherein the scoop is machine-formed prior to use.

6. The food scoop of claim 1, wherein the scoop is hand-formed prior to use.

7. The food scoop of claim 1, wherein the bottom panel comprises a pair of opposing arcuate end edges defining an upward arching of the bottom panel between the first panel and the second panel.

8. A food scoop comprising:

a body portion having a vertically elongate peripheral wall defining an upwardly opening container having a mouth to an interior lumen;

said wall comprising:

first and second panels and an upper peripheral edge defining a first closure flap foldably connected to the first panel, the first closure flap having opposing first lateral edges with a first lateral extent extending from and foldable along each first lateral edge, each first lateral extent extending to an end of the first closure flap, a first pair of oppositely-bowed fold lines defining a first hinge area between the first closure flap and the first panel, each of the first pair of oppositely-bowed fold lines having opposing ends meeting at a first apex proximate each first lateral extent, each first lateral extent at least partially defined by a first linear fold line extending from a corresponding one of the first apices to the end of the first closure flap and a second closure flap foldably connected to the second panel, the second closure flap having opposing second lateral edges with a second lateral extent extending from and foldable along each second lateral edge, each second lateral extent extending to an end of the second closure flap, a second pair of oppositely-bowed fold lines defining a second hinge area between the second closure flap and the second panel, each of the second pair of oppositely-bowed fold lines having opposing ends meeting at a second apex proximate each second lateral extent, each second lateral extent at least partially defined by a second linear fold line extending from a corresponding one of the second apices to the end of the second closure flap, at least one of the first and second closure flap moveable about a corresponding one of the first and second hinge area between an open position and a position at least partially covering the mouth; and a lower peripheral edge with a bottom panel joined thereto.

9. The food scoop of claim 8, wherein said first and second closure flaps are each movable between a raised position and a closed position along the corresponding one of said first hinge and said second hinge area.

10. The food scoop of claim 8, wherein the first and second closure flaps comprise a locking means.

11. The food scoop of claim 10, wherein said locking means comprises a male closure tab located on said first flap, and a complementary female closure tab located on said second flap.

12. The food scoop of claim 8, wherein at least one of said first and second pair of opposed extents each extends outwardly from said at least one of said first and second closure flap when said at least one of said first and second closure flap is in the open position and extends upwardly from said at least one of said first and second closure flap when said at least one of said first and second closure flap is in the position at least partially covering the mouth.

13. A blank for forming the food scoop of claim 8.

14. The food scoop of claim 8, wherein the scoop is machine-formed prior to use.

15. The food scoop of claim 8, wherein the scoop is hand-formed prior to use.

16. The food scoop of claim 8, wherein the bottom panel comprises a pair of opposing arcuate end edges defining an upward arching of the bottom panel between the first panel and the second panel.

17. A food scoop comprising:

a body portion having a vertically elongate peripheral wall defining an upwardly opening container having a mouth to an interior lumen;

said peripheral wall comprising:

first and second panels and an upper peripheral edge defining (a) a first closure flap foldably connected to the first panel, and (b) a second closure flap foldably connected to the second panel, the second closure flap having opposing lateral edges with a lateral extent extending from and foldable along each lateral edge, each lateral extent extending to an end of the second closure flap, a pair of oppositely-bowed fold lines defining a hinge area between the second closure flap and the second panel, each oppositely-bowed fold line having opposing ends meeting at an apex proximate each lateral extent, each lateral extent at least partially defined by a linear fold line extending from a corresponding one of the apices to the end of the second closure flap, the second closure flap moveable about the hinge area to a position at least covering the mouth;

a partially or fully removable panel forming a portion of at least one of the first and second closure flap; and a lower peripheral edge with a bottom panel joined thereto.

18. The food scoop of claim 17, wherein the partially or fully removable panel forms a portion of the second closure flap.

19. The food scoop of claim 17, wherein the at least one of the first and second closure flap comprises severance lines to allow the flap to function as a holder for a condiment packet when the partially or fully removable panel is partially or fully removed.

20. The food scoop of claim 17, wherein each of the first and second closure flaps comprises a partially or fully removable panel and severance lines to allow each closure flap to function as a holder for a condiment packet when the partially of fully removable panel is partially or fully removed.

21. A blank for forming the food scoop of claim 17.

22. The food scoop of claim 17, wherein the scoop is machine-formed prior to use.

23. The food scoop of claim 17, wherein the bottom panel comprises a pair of opposing arcuate end edges defining an upward arching of the bottom panel between the first panel and the second panel.

* * * * *